US006183685B1

(12) United States Patent
Cowman et al.

(10) Patent No.: US 6,183,685 B1
(45) **Date of Patent: *Feb. 6, 2001**

(54) VARISTOR MANUFACTURING METHOD

(75) Inventors: Stephen P. Cowman; Alan J. Ratcliffe, both of Dundalk (IE); Derek A. Nicker, Great Yarmouth (GB); John M. Shreeve, Norwich (GB); Anthony L. Oliver, Great Yarmouth (GB)

(73) Assignee: LittleFuse Inc., Des Plaines, IL (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

This patent is subject to a terminal disclaimer.

(21) Appl. No.: 08/468,247

(22) Filed: Jun. 6, 1995

Related U.S. Application Data

(63) Continuation of application No. 08/079,159, filed on Jun. 18, 1993, now Pat. No. 5,837,178, which is a continuation of application No. 07/935,640, filed on Aug. 25, 1992, now abandoned, which is a division of application No. 07/543,529, filed on Jun. 26, 1990, now abandoned.

(51) Int. Cl.[7] ..... B28B 1/16

(52) U.S. Cl. ..... 264/617; 264/104; 264/157; 264/160

(58) Field of Search ..... 264/61, 67, 616, 264/617, 104.157, 160; 156/89, 89.12, 89.16; 29/610.1, 612, 620; 427/102, 103

(56) References Cited

U.S. PATENT DOCUMENTS

| | | |
|---|---|---|
| 3,598,763 | 8/1971 | Matsuoka et al. . |
| 3,663,458 | 5/1972 | Masuyama et al. . |
| 3,863,193 | 1/1975 | Matsuura et al. . |
| 3,868,334 | 2/1975 | Van Loan . |
| 3,882,059 | 5/1975 | Elderbaum . |
| 3,916,366 | 10/1975 | Jefferson . |
| 4,045,374 | 8/1977 | Nagasawa et al. . |
| 4,064,475 | 12/1977 | Kouchich et al. . |
| 4,075,968 | 2/1978 | Caddock . |
| 4,148,135 | 4/1979 | Sakshaug et al. . |

(List continued on next page.)

FOREIGN PATENT DOCUMENTS

| | | |
|---|---|---|
| 0 000 864 | 3/1979 | (EP) . |
| 0 037 577 A1 | 10/1981 | (EP) . |
| 0 074 3 | 8/1982 | (EP) . |
| 0 184 182 | 6/1986 | (EP) . |
| 184 645 A2 | 6/1986 | (EP) . |
| 302 294 A1 | 2/1989 | (EP) . |
| 2 504 756 | 10/1982 | (FR) . |
| 1 487 600 | 10/1977 | (GB) . |
| 2218 260 A | 8/1989 | (GB) . |
| 1 478 772 | 7/1977 | (JP) . |

*Primary Examiner*—Christopher A. Fiorilla
(74) *Attorney, Agent, or Firm*—Chapman and Cutler

(57) ABSTRACT

Apparatus for producing multilayer varistors using ceramic ink and electrode ink consists of a succession of stations, in which alternating layers of ceramic ink and electrode ink are laid down on a substrate. The stations may be printing stations in which either a ceramic ink screen or an electrode ink screen is used to apply the appropriate ink to the substrate. In a first printing step, a layer of ceramic ink is laid down, within a region determined by a mask area of a ceramic ink screen. In the following step, electrode ink is laid down in regions determined by mask areas of the electrode ink screen. The apparatus includes transfer mechanisms for advancing substrates from station to station for successive printing operations, and control mechanisms for regulating and coordinating the successive printing operations and substrate travel.

33 Claims, 15 Drawing Sheets

U.S. PATENT DOCUMENTS

| | | |
|---|---|---|
| 4,186,367 | 1/1980 | Chakrabarty et al. . |
| 4,246,866 | 1/1981 | Hopings et al. . |
| 4,290,041 | 9/1981 | Utsumi et al. . |
| 4,296,002 | 10/1981 | Sokoly et al. . |
| 4,349,496 | 9/1982 | Levinson . |
| 4,492,163 | 1/1985 | Ericsson . |
| 4,493,254 | 1/1985 | Landesman et al. . |
| 4,551,268 | 11/1985 | Eda et al. . |
| 4,607,316 | 8/1986 | Wada et al. . |
| 4,612,689 | 9/1986 | de Wild et al. . |
| 4,638,284 | 1/1987 | Levinson . |
| 4,675,644 | 6/1987 | Ott et al. . |
| 4,730,179 | 3/1988 | Nakata et al. . |
| 4,747,211 | 5/1988 | Gilleo et al. . |
| 4,749,421 | 6/1988 | Matsui et al. . |
| 4,811,164 | 3/1989 | Ling et al. . |
| 4,859,364 | 8/1989 | Yamamoto et al. . |
| 4,863,517 | 9/1989 | Hang et al. . |
| 4,918,421 | 4/1990 | Lawless et al. . |
| 4,939,991 | 7/1990 | Szarka . |
| 4,953,459 | 9/1990 | Ericsson . |
| 4,959,262 | 9/1990 | Charles et al. . |
| 4,985,098 | 1/1991 | Kohno et al. . |
| 5,115,221 | 5/1992 | Cowman . |
| 5,134,540 | 7/1992 | Rutt . |
| 5,155,464 | 10/1992 | Cowman et al. . |
| 5,235,310 | 8/1993 | Cowman et al. . |

VARISTOR MANUFACTURING METHOD

FIELD OF THE INVENTION

This application is a continuation of Ser. No. 08/079,159, filed Jun. 18, 1993, now U.S. Pat. No. 5,837,178, which is a continuation of Ser. No. 07/935,640, filed Aug. 25, 1992, now abandoned, which is a division of Ser. No. 07/543,529, filed Jun. 26, 1990, now abandoned.

This invention relates generally to varistors, and more particularly to novel layered constructions of varistors, produced by screen printing process.

RELATED APPLICATIONS

This application is related to applications Ser. No. 07/543,528, filed Jun. 26, 1990, entitled "Varistor Ink Formulations", now abandoned; Ser. No. 07/543,921, filed Jun. 26, 19990, entitled Varistor Structures, now U.S. Pat. No. 5,115,221; Ser. No. 07/543,516, filed Jun. 26, 1990, entitled "Varistor Powder Compositions", now U.S. Pat. No. 5,235,310. The teachings of these applications are incorporated herein by reference.

BACKGROUND OF THE INVENTION

Zinc oxide varistors are ceramic semiconductor devices based on zinc oxide. They have highly non-linear current/voltage characteristics, similar to back-to-back Zener diodes, but with much greater current and energy handling capabilities. Varistors are produced by a ceramic sintering process which gives rise to a structure consisting of conductive zinc oxide grains surrounded by electrically insulating barriers. These barriers are attributed to trap states at grain boundaries induced by additive elements such as bismuth, cobalt, praseodymium, manganese and so forth.

Fabrication of zinc oxide varistors has traditionally followed standard ceramic techniques. The zinc oxide and other constituents are mixed, by milling in a ball mill, and are then spray dried, for example. The mixed powder is dried and pressed to the desired shape, typically tablets or pellets. The resulting tablets or pellets are sintered at high temperature, typically 1,000 to 1,400° C. The sintered devices are then provided with electrodes, typically using a fired silver contact. The behavior of the device is not affected by the configuration of the electrodes or their basis composition. Leads are then attached by solder and the finished device may be encapsulated in a polymeric material to meet specified mounting and performance requirements.

SUMMARY OF THE INVENTION

It is an object of the present invention to provide a method of and apparatus for manufacturing a multilayer varistor.

A multilayer varistor suitably comprises a plurality of layers of ceramic material and a plurality of layers of electrode material. The layers are interleaved with each ceramic material layer sandwiched between two electrode material layers, at least a portion of at least one of the layers of electrode material extending to a first surface portion of the varistor, and at least a portion of at least one other of the layers of electrode material extending to a second surface portion of the varistor. A first body of conductive material is adhered at least to the first surface portion for electrical communication with the portion of the at least one electrode material layer. The portion of the at least one electrode material layer being spaced from all other surface portions of the varistor by ceramic material. A second body of conductive material is adhered to at least the second surface portion for electrical communication with the portion of the at least one other electrode material layer. The portion of said at least one other electrode material layer is spaced from all other surface portions of the varistor by ceramic material. The bodies of conductive material define terminals of the varistor. Each of the ceramic material layers sandwiched individually between two electrode material layers have a thickness dimension less than 30.0 microns.

In an alternative embodiment, a multilayer varistor may comprise a plurality of layers of ceramic material and a plurality of layers of electrode material. The layers are interleaved with each ceramic material layer sandwiched between two electrode material layers. At least a portion of at least one of the layers of electrode material extends to a first surface portion of the varistor, and at least a portion of at least one other of the layers of electrode material extends to a second surface portion of the varistor. A first body of conductive material is adhered at least to the first surface portion, for electrical communication with the portion of the at least one electrode material layer. The portion of the at least one electrode material layer is spaced from all other surface portions of the varistor by ceramic material. A second body of conductive material is adhered to at least the second surface portion for electrical communication with the portion of the at least one other electrode material layer. The portion of the at least one other electrode material layer is spaced from all other surface portions of the varistor by ceramic material. The bodies of conductive material define terminals of the varistor. Each ceramic layer is individually sandwiched between two electrode material layers, and each is formed by deposition of a powder suspension and subsequent heat treatment to provide a dense continuum of ceramic material of low porosity. Each ceramic layer may be formed by a multiple depositions of powder suspension aggregated by the heat treatment to provide a dense continuum of low porosity ceramic material.

Each layer of ceramic material separating two layer of electrode material is of substantially the same thickness as every other layer of ceramic material separating two layers of electrode material, and the thickness is substantially uniform over the entire area of the separating layer of ceramic material. Each layer of electrode material may be of substantially the same thickness as every other layer of electrode material, with the thickness being substantially uniform over the entire area of the layer of electrode material.

At least one of the layers of electrode material may be separated from an external surface portion of the varistor by a layer of ceramic material of greater thickness than the thickness of any of the layers of ceramic material separating two layers of electrode material. Alternatively or in addition, at least one of the layers of electrode material may be separated from an external surface portion of the varistor by a layer of ceramic material of a different composition from that of the separating layer of ceramic material.

At least one of the plurality of layers of electrode material may be defined by a single region of electrode material. Alternatively, at least one of the plurality of layers of electrode material may be defined by a plurality of individual regions of electrode material.

In a preferred embodiment and construction, a multilayer varistor of the invention is of generally rectangular block form configuration, and the layers of electrode material are substantially planar, and extend substantially parallel to those side faces of the varistor which are of maximum planar dimensions. The end faces of the rectangular block-form varistor define the first and second surface portions.

In an alternative embodiment, a multilayer varistor may be of generally cylindrical configuration, with the layers of electrode material being substantially planar and extending transverse to the axis of the generally cylindrically configured varistor. The first surface portion and the second surface portions are defined by curved surface portions of the varistor. One of the first and second surface portions may be an external, convexly-curved surface portion of the annular varistor, and the other of the first and second surface portions may be an internal, concavely-curved surface portion of a central aperture passing through the annular member.

In any configuration of multilayer varistor, of the various embodiments of the invention at least one layer of electrode material, and the at least one other layer of electrode material, together define said plurality of electrode layers. Thus, a multilayer varistor may also consist of three layers of ceramic material and two layers of electrode material, with one of the ceramic layers being sandwiched between the two electrode material layers. A first layer of the layers of electrode material extends to a first external surface portion of the varistor, and the other of the layers of electrode material extends to a second external surface of the varistor. A first body of conductive material is adhered at least to the first external surface portion for electrical communication with the first electrode material layer. The first electrode material layer is spaced from all other external surface portions of the varistor by ceramic material. A second body of conductive material is adhered to the second external surface portion for electrical communication with the other electrode material layer. The other electrode material layer is spaced from all other external surface portions of the varistor by ceramic material. The bodies of conductive material define terminals of the varistor. The ceramic layer sandwiched between the two electrode material layers is formed by deposition of a powder suspension, and subsequent heat treatment thereof to provide a dense continuum of ceramic material of low porosity.

According to an embodiment of the invention, there is provided apparatus for producing varistors comprising:

(a) at least one station for applying a ceramic ink to a substrate material;

(b) at least one station for applying a non-ceramic ink to a substrate material;

(c) transfer means linking said stations for advance of substrate material portions from station to station; and (d) control means for regulating and coordinating printing operations and substrate travel.

The apparatus may more particularly consist of:

(a) at least one screen printing station for applying a ceramic ink to a substrate material;

(b) at least one screen printing station for applying a non-ceramic ink to a substrate material;

(c) transfer means linking the printing stations for advance of substrate material portions from station to station; and (d) control means for regulating and coordinating printing operations and substrate travel.

The stations may be a plurality of ceramic ink printing stations, and may be disposed in a continuous closed path.

Each station of the apparatus of the invention may comprise:

(a) means for supporting a substrate plate at least during a printing operation;

(b) means for supporting a printing screen;

(c) an ink spreader bar; and (d) a squeegee for urging the screen against the substrate material during a printing operation.

In yet another aspect, the invention provides a method for producing varistors comprising the steps of:

(a) applying a first layer of a ceramic material to a substrate;

(b) applying a multiplicity of areas of conductive material to the ceramic layer;

(c) applying a further ceramic layer to cover the multiplicity of conductive areas;

(d) repeating steps (b) and (c) at least once;

(e) applying a final layer of ceramic material to cover a multiplicity of the conductive areas; and (f) detaching the ceramic composition/conductive material product from the substrate.

The method may more particularly comprise the steps of:

(a) printing a first layer of a ceramic material onto a substrate;

(b) printing a multiplicity of areas of conductive material onto the ceramic layer, (c) printing a further ceramic layer to cover the multiplicity of conductive areas;

(d) repeating steps (b) and (c) at least once;

(e) printing a final layer of ceramic material to cover a multiplicity of the conductive areas; and (f) detaching the printed ceramic composition/conductive material product from the substrate.

The method of the invention suitably comprises the further step of dividing the printed layers to provide a multiplicity of varistors, each having a plurality of layers of ceramic material and a plurality of layers of electrode material. The layers are interleaved with each layer of electrode material being sandwiched between two ceramic layers. The dividing step may provide at least a plurality of varistors in each of which at least one layer of electrode material comprises a plurality of areas of conductive material.

The method of the invention may comprise an additional step in which a multiplicity of areas defined by a marker material are printed onto the external surface of the final layer of ceramic material, to provide an external indication of the location of at least one of said layers of conductive material. Preferably, the parameters of the ceramic composition printing step are controlled to provide a printed ceramic layer of uniform thickness over the full printed area. The parameters of the conductive material printing step may also be controlled to provide electrode material layers of controlled thickness over their full area.

BRIEF DESCRIPTION OF THE DRAWINGS

Various embodiments of the present invention will be described in detail below relative to the associated drawings, in which like items are identified by the same reference designation, wherein.

DETAILED DESCRIPTION OF THE INVENTION

Figure 1:
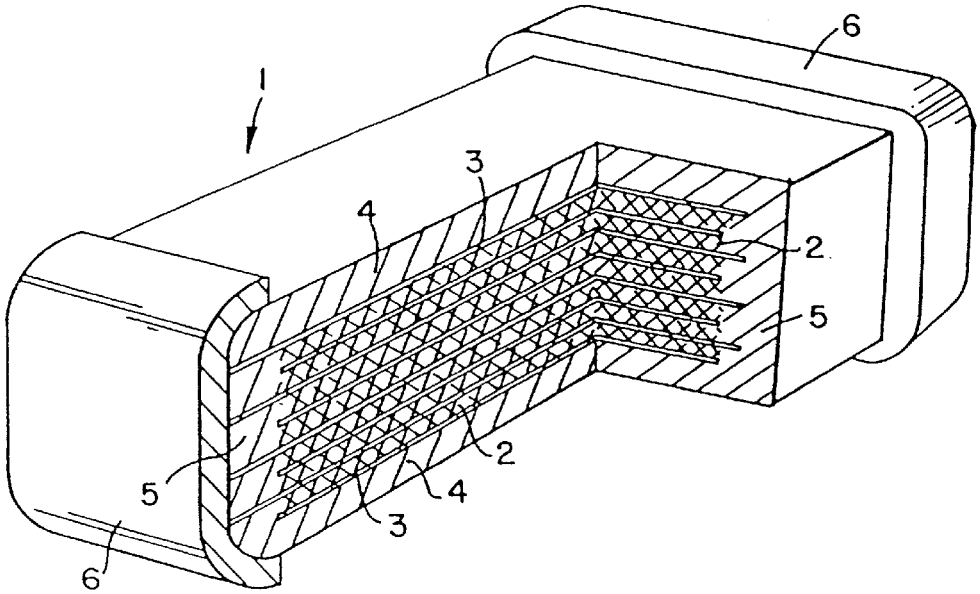
FIG. 1 is a part cut-away pictorial view of a multilayered varistor produced by the present method and apparatus in one embodiment of the invention.
Figure 2:
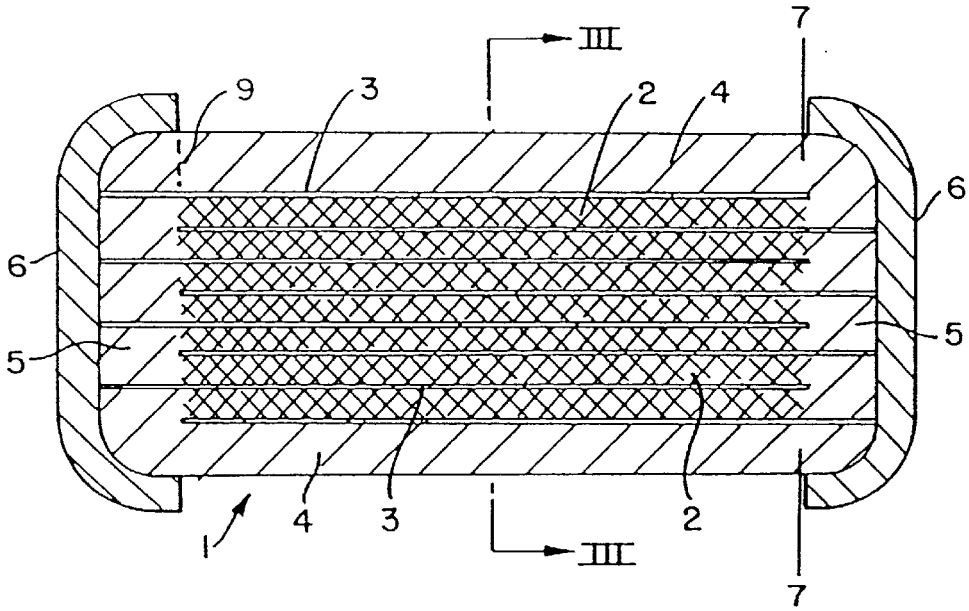
FIG. 2 is a sectional view of the varistor of FIG. 1 on a longitudinal section plane.
Figure 3:
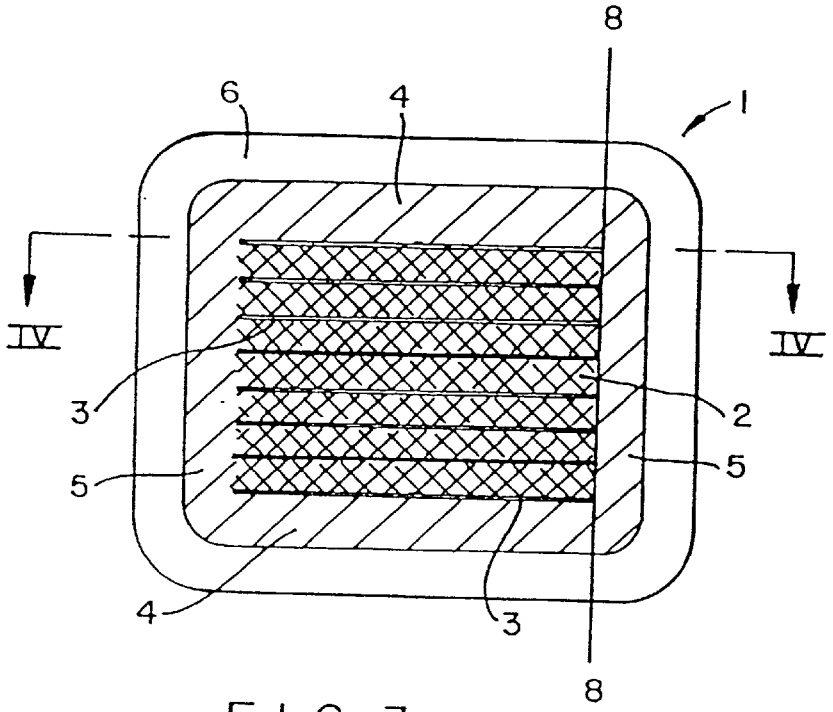
FIG. 3 is a transverse sectional view of the varistor of FIGS. 1 and 2 on the section plane III—III of FIG. 2.
Figure 4:
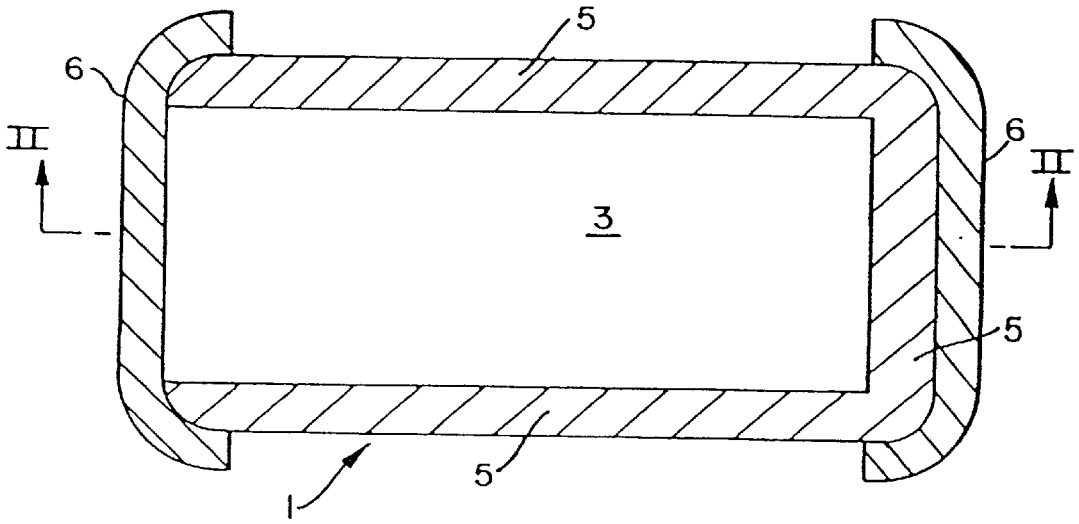
FIG. 4 is a sectional view from above of the varistor of FIGS. 1, 2, and 3 on the section plane IV—IV of FIG. 3.

As shown in FIGS. 1 to 4, a varistor 1 is formed from a multiplicity of interelectrode ceramic layers 2, each of which is sandwiched between upper and lower electrode layers 3. This sandwiched construction is encased in upper and lower outer ceramic layers 4 by peripheral ceramic zones 5 on the sides and certain end portions of the electrodes. At each axial end of the generally rectangular varistor 1 shown in these drawings, alternate electrode layers 3 are carried to the axial end faces of the ceramic material, where they are in conductive association with end terminal caps 6, typically formed from silver/palladium coatings. A typical dimension for a varistor 1 of this kind is 3000.0×2500.0 microns, one micron being equal to one thousandth of a millimeter. The electrode layers may be approximately 0.3 to 4.0 microns thick, while the interelectrode ceramic layers 2 may vary between 10.0 and 600.0 microns, depending on the performance requirements of the unit. The outer ceramic layers 4 are typically up to three times the thickness of the interelectrode ceramic layers 2, and may therefore be between 30.0 and 1800.0 microns thick, as are the side ceramic zones 5 and the ceramic material sections axially outward of the electrode layer ends not connected to an end terminal cap 6.

According to an aspect of the present invention to be described hereinafter, a layered varistor structure 1 of this kind is suitably produced by a screen printing process, in which close control is maintained over the thicknesses of the successive layers. In addition, parallelism between electrode layers in a multilayer varistor 1 is of first importance. Electrode layers 3 should be parallel within relatively close limits, as all of the electrode layers 3 must fire at the same time, when the device is activated.

In summary therefore, in order to ensure proper performance the end term caps 6 via the electrode layers 3, then tracking can take place at this part of the unit.

Figure 5:
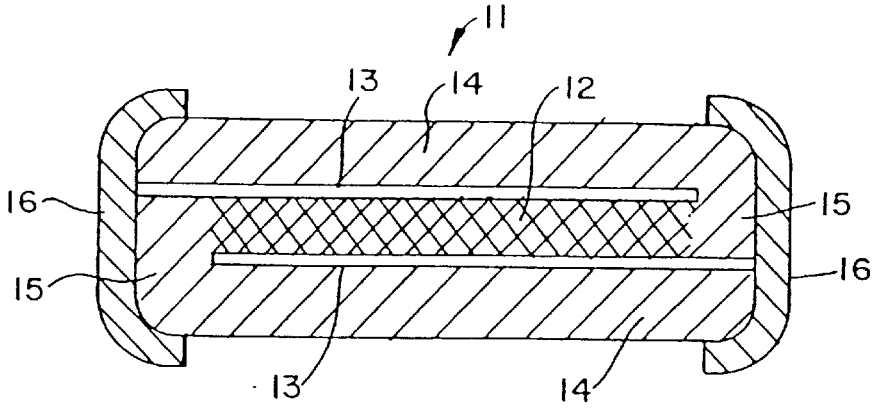
FIG. 5 is a longitudinal sectional view of a further novel configuration of a layered varistor.

FIG. 5 illustrates an alternative construction 11 of a varistor 11 according to another embodiment of the present invention, in which only a single layer of interelectrode ceramic material 12 is provided between two electrode layers 13. These electrode layers 13 are spaced from the exterior of the varistor by outer ceramic layers 14. One end of each of the electrode layers 13 extends outward to an end term cap 16. The other ends of the electrode layers extend to an associated peripheral zone 15. The operation of this device 11 and its manufacture take place in similar manner as already described for the embodiment of FIGS. 1 to 4.

The varistors 1,11 of FIGS. 1 to 4, and FIG. 5, respectively, are required to have in the outer ceramic layers 4 and 14, respectively, essentially an insulating layer. This insulating layer may be defined in the manner shown in FIG. 6 for a varistor broadly similar to that of FIGS. 1 to 4, by having the outer layer 21 of ceramic material of greater thickness than the interelectrode ceramic layers 2. In this way the possibility of undesired tracking taking place between the end term cap 6, where it is carried around the profiled corners 23 of the generally rectangular varistor block 1, and the outermost electrode layers 3, closest to the upper and lower surfaces 24, is reduced. Typically the thickness of this outer layer 21 should be, as shown in general terms in FIG. 6, approximately three times the thickness of the interelectrode ceramic layers 2.

Alternatively, the outer layer 21 of ceramic material may be formed from a ceramic of a different composition, as designated by reference 22 in FIG. 7, which again represents a varistor 1 broadly similar to that of FIGS. 1 to 4. In this instance, the ceramic material of the outer layer may be of the same basic formulation as that of the rest of the varistor 1, but have a finer structure, thereby providing a greatly increased number of grain boundaries, which increases the resistance of the outer layer greatly as compared with that of the interelectrode ceramic layers 2. Again in this manner, the proneness of the outer layer 22 to undesired tracking may be reduced. Alternatively, a ceramic material of a different composition may be used for the outer layer 22, but it may nonetheless be desirable to have a greater thickness of this differently formulated ceramic material in the outer regions 22 of the varistor 1, for improved safety and security. Around the edges of the electrode layers 3 where they do not extend to the end term cap 6, the ceramic material is also provided in sufficient thickness and/or of an appropriate composition to ensure that outward tracking cannot take place. The use of a different ceramic material for the outer layers 22 may also be used together with enhanced thickness in these layers 22, the outer layers 22 being for example up to three times the thickness of the ceramic interelectrode layers 2. Thus in summary, the electrode material 3 may be the same throughout the product with outer layers 22 of enhanced thickness, or the outer layers 22 may be of different material without thickness enhancement or with only a modest degree of increased thickness, or finally, the outer layers 22 may be of different material and also of significantly greater thickness than the interelectrode layers 2.

Figure 8:
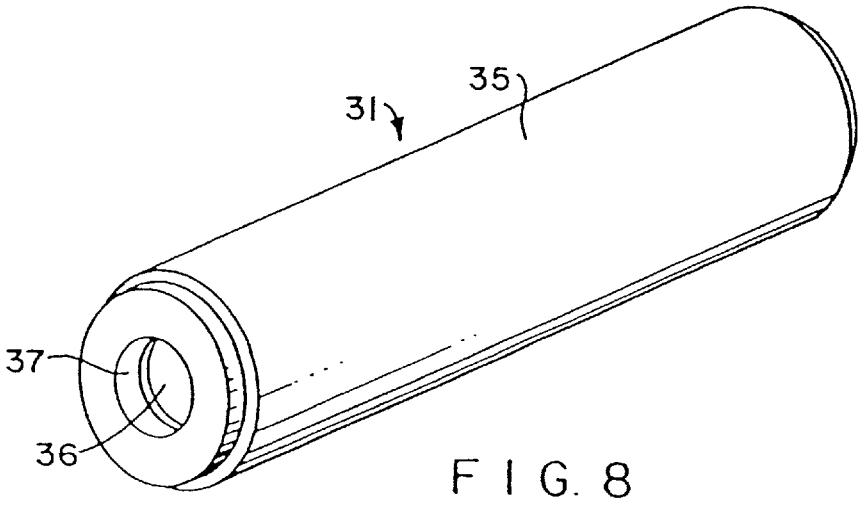
FIG. 8 is a pictorial view of a connector pin configuration of a varistor for an embodiment of the invention.
Figure 9:
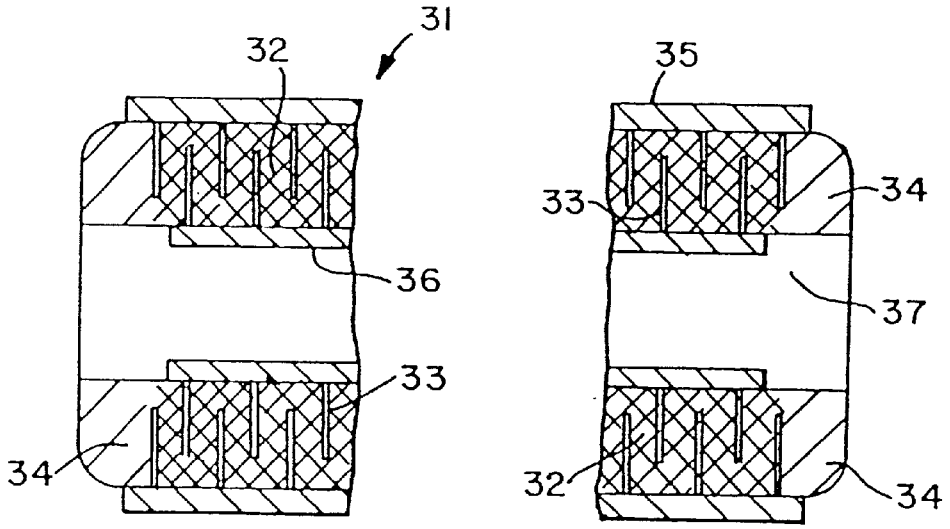
FIG. 9 is an axial view of the pin connector of FIG. 8.

FIGS. 8 and 9 show a connector pin 31 configuration of a multilayer varistor. A pin 31 has interelectrode ceramic layers 32 between electrode layers 33. End ceramic layers 34 are again provided in similar manner to the rectangular constructions of FIGS. 1 to 6 to be of greater thickness and/or different composition, as appropriate. An outer terminal cap 35 is provided on the exterior of the generally cylindrical connector pin 31, while an inner terminal cap 36 is provided within the axial hole passing through the connector pin, represented as central bore 37. Alternate electrode layers 33 extend either to the outer surface of the ceramic material for electrical communication with outer terminal cap 35, or in similar manner to inner terminal cap 36.

Figure 10:
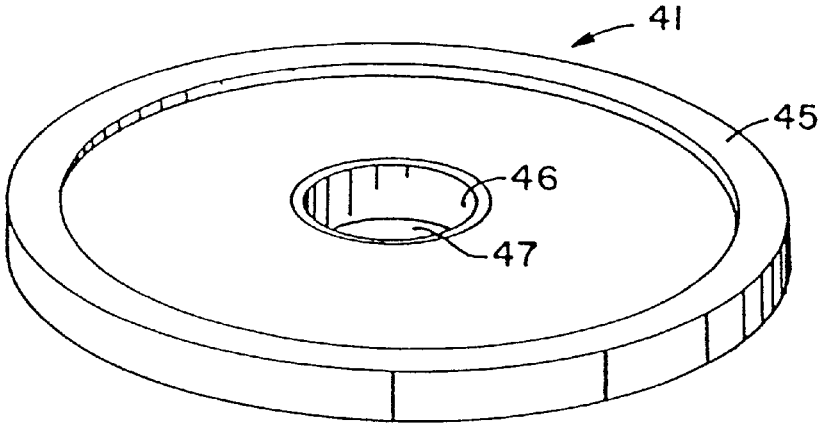
FIG. 10 is a pictorial view of a discoidal configuration of a multilayer varistor of an embodiment of the invention.
Figure 11:
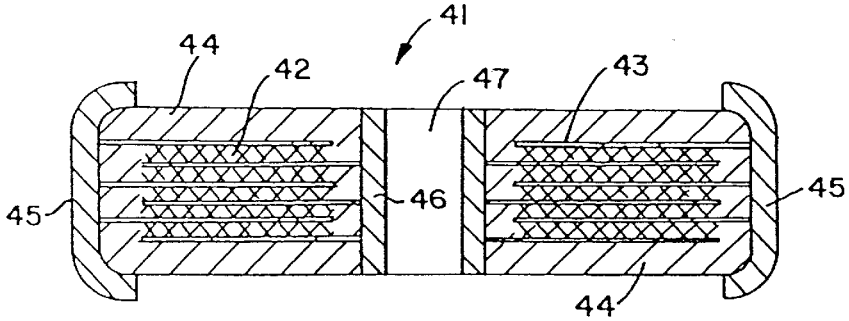
FIG. 11 is an axial section through the varistor of FIG. 10.

FIGS. 10 and 11 show a discoidal construction 41, in which interelectrode ceramic layers 42 are located between electrode layers 43 and again separated from the exterior end surfaces of the disc by thicker layers 44. An outer terminal cap 45 extends around the external circumference of the disc, while an inner terminal cap 46 is defined by metalizing the interior of the central bore 47.

Alternate electrode layers 43 are conductively connected either to outer cap 45 or to inner cap 46.

Advantages of the multilayer arrangement are that the effective conductive area may be increased, compared with a conventional radial construction of varistor. When the multilayered varistor is switched on, conduction takes place between each pair of electrodes 43, one of which is connected to the first end terminal 45, and the other of which is connected to the other end terminal 46, through the intervening ceramic layer 42. Thus, within a compact structure, a multiplicity of electrically parallel conductive paths are provided in the switched-on condition, as compared with the single such path of a radial device.

In addition, on account of the electrodes 43 being contained fully within the ceramic structure, i.e. buried, improved voltage capabilities may also be provided. In particular, in the construction of FIG. 5, where just two buried electrodes 13 are used with a single intervening interelectrode ceramic layer 12, a device of high voltage capability may be provided which nonetheless has a low capacitance.

Figure 12:
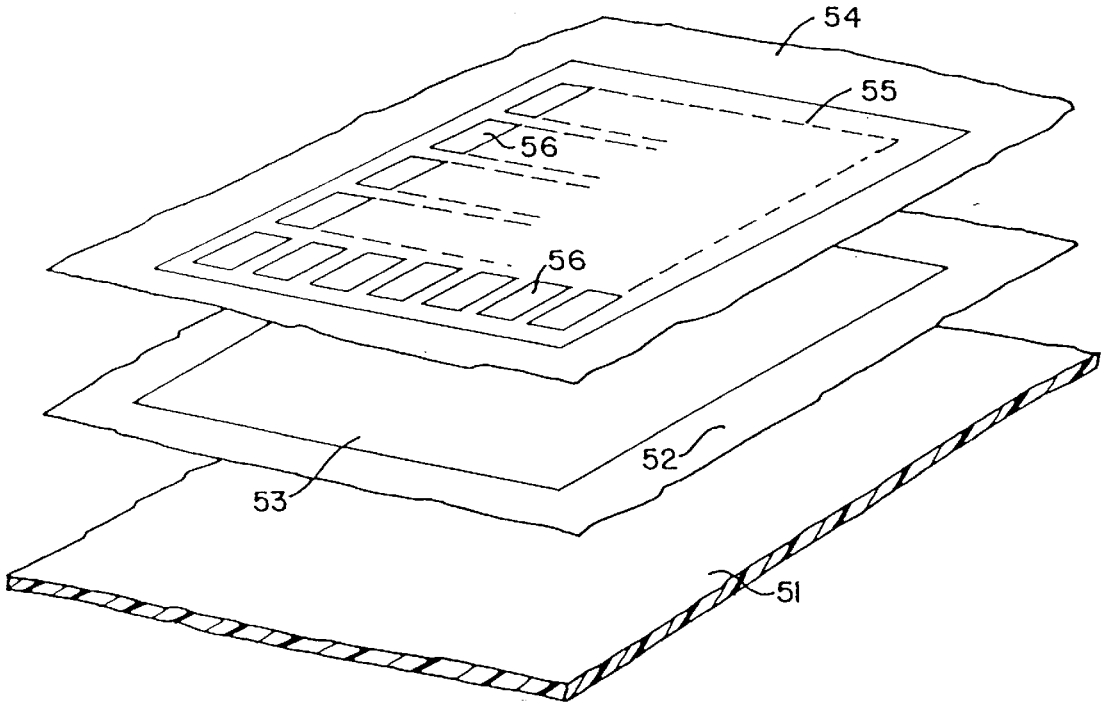
FIG. 12 is a diagrammatic representation of the substrate and screens used in the preparation of varistors of the kind illustrated in particular in FIGS. 1 to 4, or FIGS. 6 or 7, in one embodiment of the invention.

All of the foregoing embodiments of the invention for alternative constructions of a varistor may be built up by a screen printing process, certain aspects of which are shown in the general representation of FIG. 12 for the rectangulate varistors of FIGS. 1 to 4, FIG. 5, and FIGS. 6 and 7, but precisely similar constructional techniques apply to the connector pin and discoidal configurations of FIGS. 8 to 11. As shown in FIG. 12, the varistor layers are built up on a substrate 51. The ceramic layers are laid down by use of a first screen 52. This first or ceramic layer screen 52 has a mask area 53 defining the size of the ceramic layer created during a ceramic layer printing step. In the printing operation, which takes place in a manner known in principle, a ceramic ink is flooded onto the screen 52 and is forced through the mask area 53 under a squeeze action to define a ceramic layer on the substrate. In the next printing step, an electrode screen 54 having a mask area 55 is used. Within the mask area 55, a multiplicity of electrode areas 56 are defined. Printing of the electrode areas onto the ceramic layer takes place in the same manner as that in which the ceramic layer itself was formed, an electrode ink being flooded onto the screen and forced through the mask spaces 56 to define a multiplicity of ink patches on the ceramic layer. Each layer, whether ceramic or of electrode material, must be substantially dry before the next printing operation takes place.

In each case, the ceramic varistor material ink is flooded onto the screen and forced through the masked area to define the further ceramic layer. In order to provide the external connections of the electrodes to the end term caps, each successive electrode layer is displaced relative to the preceding electrode layer so as to ensure that the necessary end connections may be made. When the layers are built up to whatever extent is required, the final product is completed by application of the final external ceramic layer. As already described, the first and last ceramic layers are of greater thickness than the interelectrode layers. In addition, or alternatively, they may be formed using a ceramic ink of a different composition. A final printing step may involve using a marker ink, e.g. a carbon ink, to print on the outer ceramic surface of the product, patches aligned with one of the internal electrode print layers for enabling cutting planes to be determined for division of the completed printed product into a multiplicity of individual varistor units. The finished substrate is then separated or cut up into a multiplicity of rectangulate blocks, the cutting planes being arranged in such a way as to ensure that each electrode layer extends to an appropriate end face of a finished separated block in the manner required by the finished structure, as depicted in FIGS. 1 to 4 in particular, i.e. alternate electrode layers extending to opposite ends of the rectangulate blocks, but with the opposite end of each electrode layer remaining buried within the ceramic material.

Precisely similar manufacturing methods may be applied to the axial constructions of FIGS. 8 through 11. In this case, the successive laying of the layers takes place in the axial direction of the finished product, and the masks for the electrode layers are of circular or annular shape. The cutting out of the finished product takes place using similar methods to those for rectangular blocks, adapted to the alternative shapes required for these further configurations.

Figure 6:
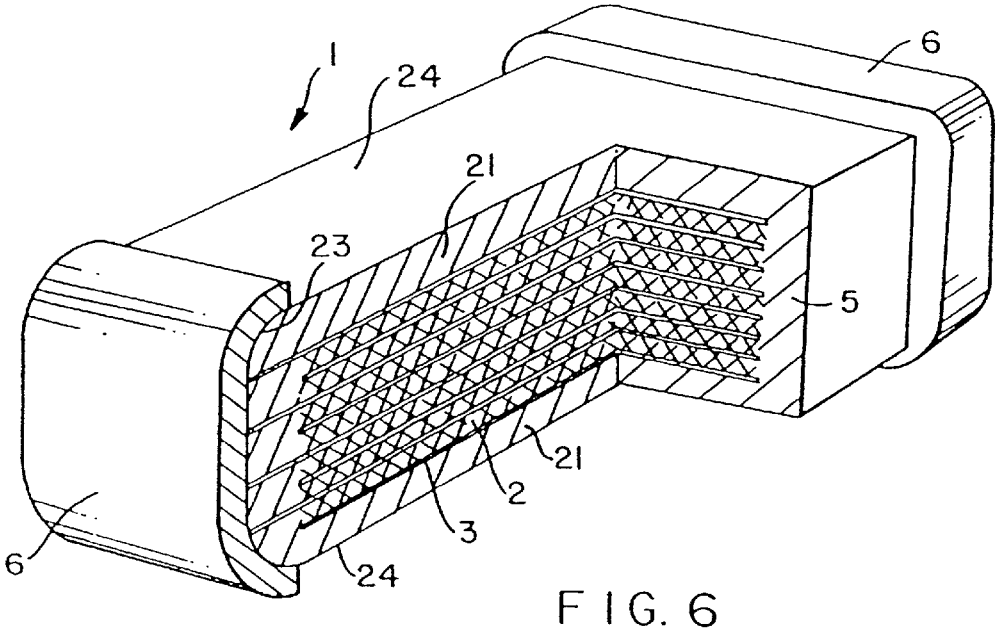
FIG. 6 is a sectional view similar to that of FIG. 2 of a further construction of a layered varistor.
Figure 7:
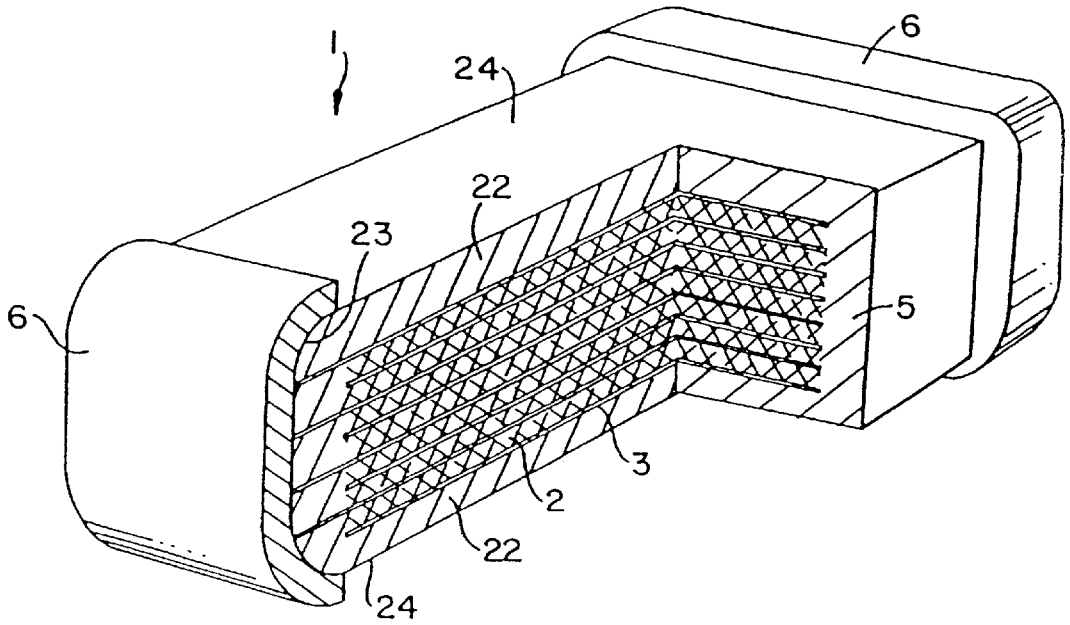
FIG. 7 is a longitudinal sectional view, again similar to that of FIG. 2, of another embodiment for a construction of a multilayer varistor.

Following cutting up of the layered varistor material to provide individual units, the product is treated to remove sharp corners and edges, to define the rounded edges or corners indicated by reference 23 in FIGS. 6 and 7 in particular. Bake out and firing then takes place in a known manner and end terminal caps 6, for example, are applied. Typically, these are made from a silver/palladium material, to facilitate soldering of the formed varistors to other circuit structures.

This method or process for producing varistors according to the invention as briefly summarized and set forth in the foregoing paragraphs may now be explained in more detail, with reference to FIGS. 13 to 18, previously adverted to in the brief description of the drawings.

Figure 13:
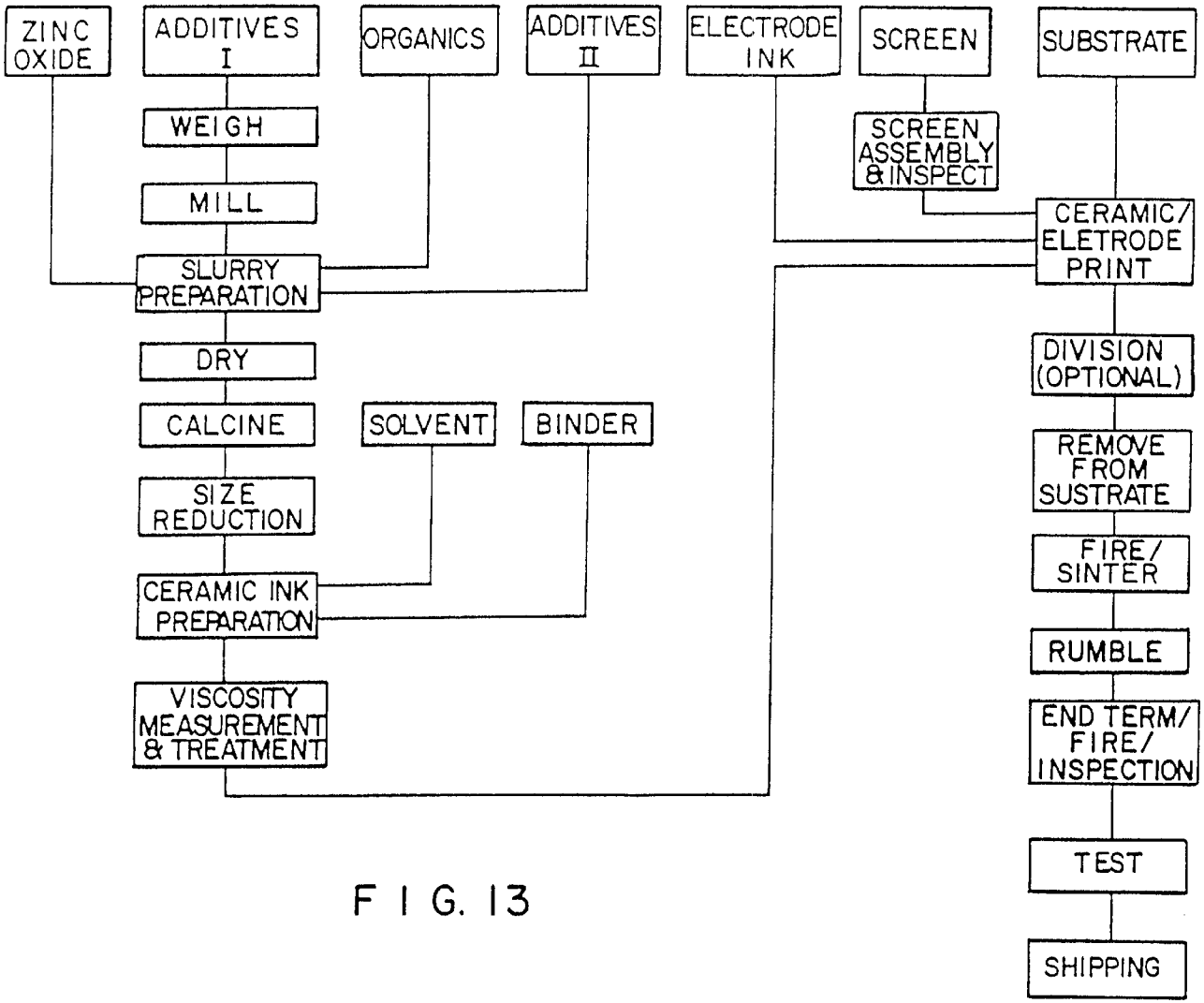
FIG. 13 is a flow diagram showing the steps involved in preparing the various component constituents and parts involved in and required for the manufacture of multilayer varistors using a screen printing technique of an embodiment of the invention.

Considering first FIG. 13, which is a flow diagram showing the provenance and handling steps involved in preparation of each of the constituents and component parts used in the manufacturing method, the left-hand side of the diagram deals broadly with the preparation of the physical constituents, as set forth in greater detail in co-pending applications, while the right-hand part sets forth the sequence of mechanical steps involved in handling the components used in the method, as already summarized above.

Turning to the left-hand side of the drawing, the initial stages of preparation involve the procurement of appropriate quantities of zinc oxide powder, additives and organics. The zinc oxide powder, additives and organics are brought together in a slurry preparation step, following which the resultant product is spray-dried, calcined for size reduction, and dried. Preparation of ceramic ink then takes place, the calcined powder being combined with further organics. The resultant ink undergoes a viscosity measurement check prior to its use in the varistor production method of the invention.

Adverting now to the right-hand side of the drawing, electrode ink is procured, suitable screens for ceramic and electrode printing are prepared, assembled and inspected, and finally, substrates are also prepared. The substrates are loaded into the printing machine, where the central steps of the present process takes place. Downstream steps include separation of the finished varistor(s) from the substrate, cutting of the slab-form product to provide individual varistor units, as required, firing and sintering, rumbling to remove sharp edges and corners from the separated individual product units, as noted above, inspection, test and final output stages preparatory to shipment.

A preferred configuration of a substrate for use in the method of the invention is a square planar member. A relatively close quality control check is applied to the dimension of the substrates to ensure that they will survive without difficulty the multiplicity of transfer operations and printing steps involved in use of the method of the invention.

The printing machine of the present method accommodates multiple substrate units during each print run. Thus for each printing operation to be carried out on the printing machine of the invention, an appropriate number of substrate units is loaded into a cassette, all of the plates being of the same thickness. The substrate units are advanced from the cassette for use in the printing machine.

In use of the printing machine of the invention, substrates are loaded into the system at a loading station and travel along a track from printing station to printing station in a generally forward movement. It is necessary that each print layer be substantially dry before application of the next layer of ceramic or electrode ink, as appropriate, and to this end, the apparatus may be provided with drying means so that each printing of ink is thoroughly dried before the substrate reached the next printing station. Four printing stations may be provided, three of which are used for the application of ceramic ink, while the fourth serves for laying the electrode layers, and the printing stations may be located along a continuous closed path traversed by the substrates. The entire printing operation and advance of transfer of substrates is suitably controlled by computer means.

The printing operation will now be described having regard to FIG. 14. All four printing stations are in essence identical and each has a member for supporting a substrate 51 during a printing operation. The printing screen 52 is located above the substrate 51 during the printing operation by suitable support means. The printing head structure includes a flood bar (not shown), which spreads ink over the screen 52 during a forward ink-spreading stroke. A squeegee 84 is located in advance of the flood bar, during this forward ink-spreading phase. The squeegee 84 is raised above the surface of the ink and out of contact with both screen and ink during the flooding step. For the actual printing operation, the squeegee 84 drops down from its raised position during the flooding operation into a printing disposition in which it remains during the printing or backstroke, indicated by arrow 85 in FIG. 14. The disposition, shape and configuration of the squeegee 84 is such that the ink is applied to and printed onto the substrate 51 during this return or backstroke.

Figure 14:
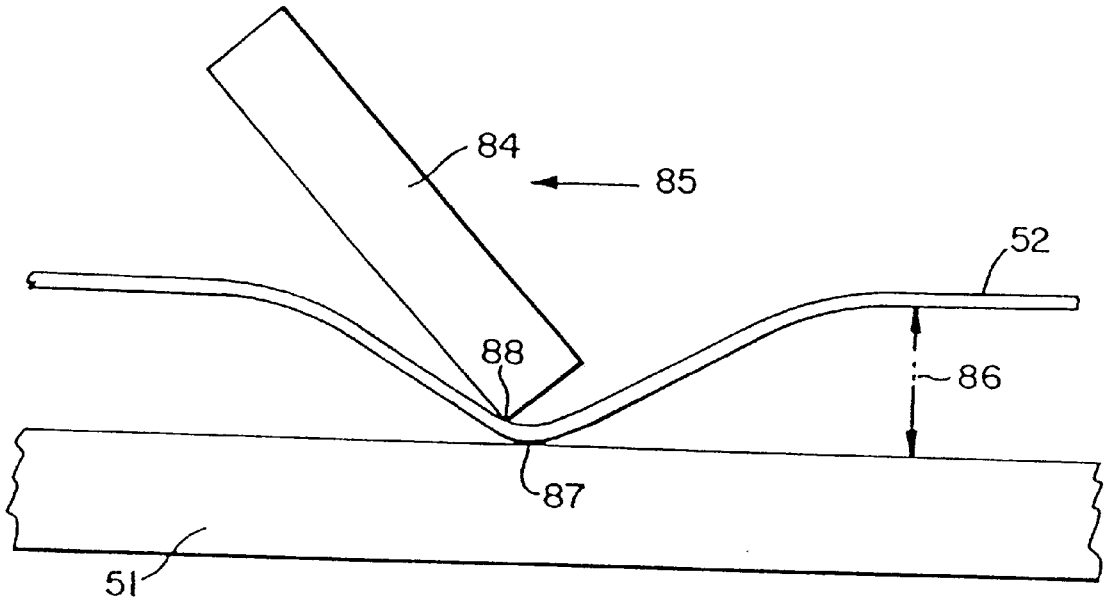
FIG. 14 is a schematic side view of a portion of a screen printing station used according to one embodiment of the invention in the production of varistors, showing the screen snap-off effected by the squeegee during the printing operation.

In the printing position of the substrate 51, there is a so-called snap-off distance between the screen and the substrate, as shown in FIG. 14 by reference 86. As the squeegee 84 travels across the screen 52 during the printing or return stroke, the screen is forced downwardly through this snap-off distance 86 until it comes into contact with the top of the material already printed onto the substrate 51, if it is a downstream printing operation, or the substrate 51 itself, in the first printing operation. The profile of the squeegee 84 is such that the screen material 52 ahead of it, in the direction the squeegee 84 travels, slopes downwardly to the surface 87 of the print area and then swings upwardly fairly abruptly to the rear of the squeegee 84 squeezing edge 88. The term snap-off refers to the snapping-back action of the screen material to the rear of the squeegee 84, which results in an effective and smooth printing operation and is also a function of screen tension.

To achieve the desired action, the squeegee 84 is therefore suitably an elongate, transversely-disposed bar of hard rubber, of rectangular cross-section in end view, with its longer cross-sectional axis extending upwardly from the screen 52. The squeegee 84 is also inclined forwardly in the direction of the printing stroke so that this longer cross-sectional axis is not vertical but slopes forwardly in the print direction. The contact zone between the squeegee 84 and the screen 52 is the leading lower corner 88 of the squeegee 84 cross-section, i.e. the leading edge in the print direction of the lower shorter edge or face of the rectangular cross-section rubber bar.

A variety of different screen sizes may be used. Different screens 52 may be used at different printing positions. A multiplicity of combinations of optimum screen sizes exist, adapted to particular products, and a variety of different combinations of screen size may be used in the different printing positions.

It is important that all screens 52 used in the system of the invention are of adequate quality, and this involves both visual inspection for coining, that is raised areas or indentations in the screen 52, and for pin-holes, blockages in the mesh, and mesh and frame damage to be carried out before using the screens 52, as well as which screen tension is checked.

During formation of a layer, whether of ceramic material or of electrode material, the substrate 51 may pass through a number of printing stations spaced along the path of the substrate as it advances through the machine, which may be a continuous closed path. Several hundred varistor units may be printed on each substrate 51, the actual number being more or less dependent on the unit size. Depending on the thickness of each print, ceramic layers may be formed by successive traverses through the printing stations to build up the required ceramic layer thickness. When the ceramic layer thickness is sufficient, an electrode layer is laid down by printing electrode ink onto the ceramic material. This electrode layer is typically 1.0 micron thick, but the layer thickness may vary within, for example, range from 0.3 to 5.0 microns. Irrespective of the varistor structure, the electrode layer is defined by a single print operation only. Thus the variable in layer printing is the number of ceramic ink prints that take place, and control of the overall ceramic material thickness is varied by increasing or reducing the number of ceramic printing steps.

Each ceramic layer covers the entire area of the substrate 51, whereas, as has already been indicated in regard to FIG. 12, the electrode screen 54 defines a multiplicity of print areas 56, the separation of the finished varistor slab on the substrate 51 into individual units along and through the electrode layers, and the continuous ceramic zones between the electrode print areas 56, that provide the finished products of the invention, when production of a multiplicity of individual units is required.

In order therefore to identify the planes along which this cutting and separation should take place, the final print operation of a complete manufacturing cycle is carried out by replacing the electrode ink with an ink suitable for providing a marker print on the external tip surface of the printed slab of varistor material on the substrate 51. This ink may be a carbon ink, or it may comprise any material, for example, an organic dye, which is capable of becoming lost during bake out or firing and which does not react with any of the primary constituents of the varistor. In case of a carbon ink, the marker print enables black patches or areas to be printed on the outer ceramic surface of the product, these patches being aligned with one of the electrode layers printed within the varistor slab on the substrate 51 and enabling the cutting planes to be determined. In other words, the carbon regions enable registration of the cutting means. This carbon material burns off and disappears completely during subsequent downstream treatment of the finished products.

The marker ink print step on the upper slab surface may be avoided by providing for accurate registration of the varistor slab during the cutting phase using other means, but an external visually-apparent marker print represents a convenient method of ensuring accurate division of the slab-form product, where required.

Figure 15A:
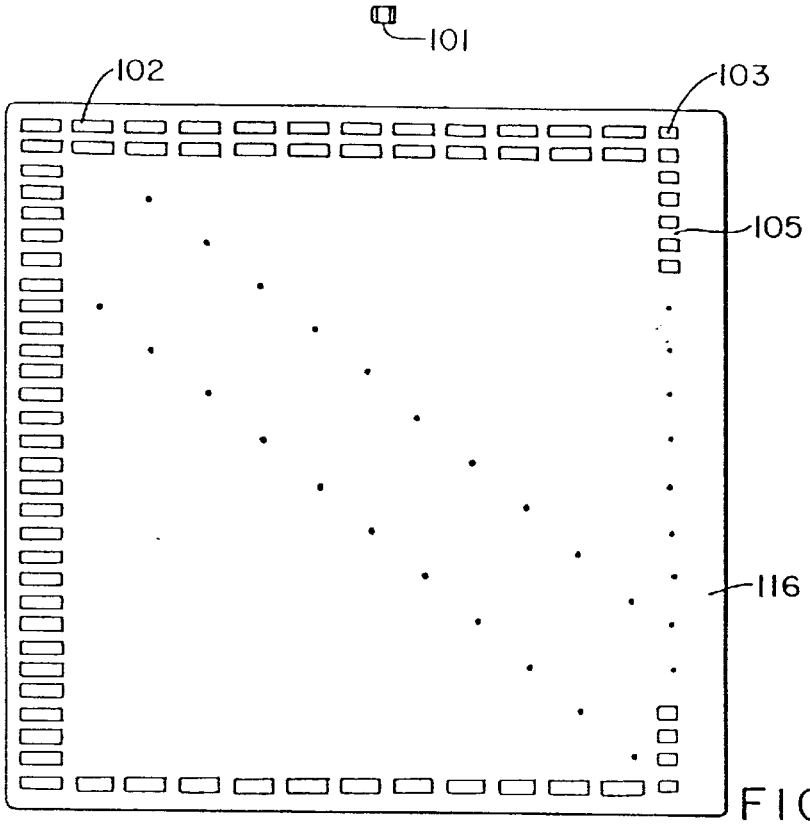
FIGS. 15A and 15B show the arrangement and orientation of successive electrode layers in a printing operation, with a finished product shown alongside the printed substrate for comparison purposes.
Figure 15B:
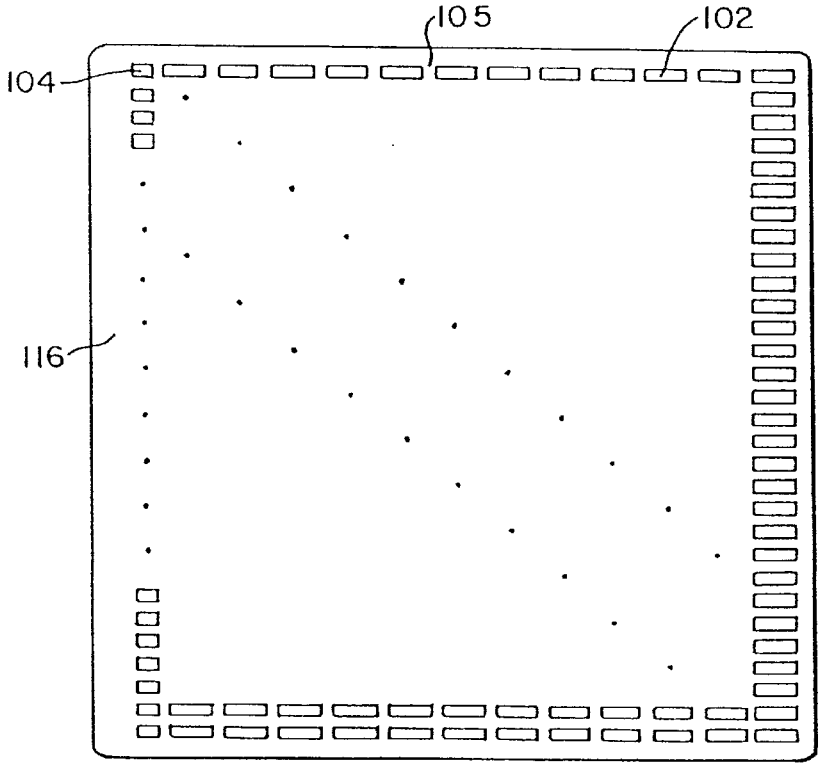

FIGS. 15A and 15B show an arrangement for printing successive electrode ink layers in a multilayer varistor 101 of generally rectangulate final configuration. In each layer of this particular exemplary configuration, the electrode ink zones 102 are generally rectangular in shape and axially elongate, save only for the last electrode zone 103 (see FIG. 15B) in the longitudinal direction, which is approximately one-half of the axial length of the other electrode areas 102. After each electrode ink print takes place, the electrode material is overlaid with ceramic material and a further electrode layer then placed over the ceramic layer. This next electrode layer is reversed relative to the previous layer, so that the short electrode zones 104 (see FIG. 15B) are in this case at the opposite axial end from those 103 of the first layer. Thus the divisions 105 between electrode patches or zones in each layer are displaced in the elongate direction of the electrode zones by one-half an electrode zone pitch relative to those of the layers above or below it in the varistor. The reason for this staggered arrangement will become apparent in a subsequent drawing showing the cutting arrangement.

The presence or absence of the "half-row" 103 or 104 of the example of FIGS. 15A and 15B depends on the relative dimensions of the finished units and the substrate. In alternative configurations, such a "half-row" may not be present. However, at least in all instances where sub-division of the printed slab is required, the alternating axial displacement between successive electrode layers is necessary, irrespective of the presence or absence of the "half-row".

Figure 16:
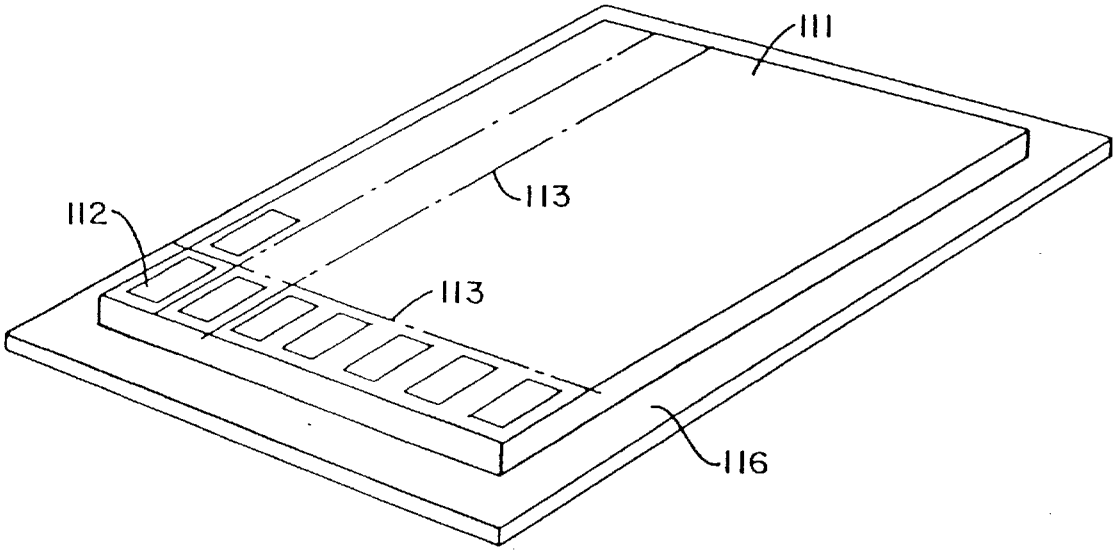
FIG. 16 is a pictorial view of the final print on the upper surface of the varistor aggregate which is used to provide a guide during a cutting step in an embodiment of the invention.

The carbon ink print on the top surface of the varistor product suitably corresponds to the second last electrode pattern laid down, before the final ceramic print and the placement of the carbon ink. FIG. 16 is a pictorial view of the upper surface of a varistor product 111 with the carbon ink 112 printed onto it, also indicating the separating or cut planes 113, for division of the slab-form product to provide individual varistor units and their removal from substrate 116.

On completion of the last printing step, the substrates are advanced to the cutting and separation or dividing stages of the manufacturing system.

At the cutting phase, the varistors are separated into individual units by cutting down through the continuous ceramic material and through the electrode-defining layers along respective planes determined by the location of the carbon regions 112 of the surface.

Figure 17:
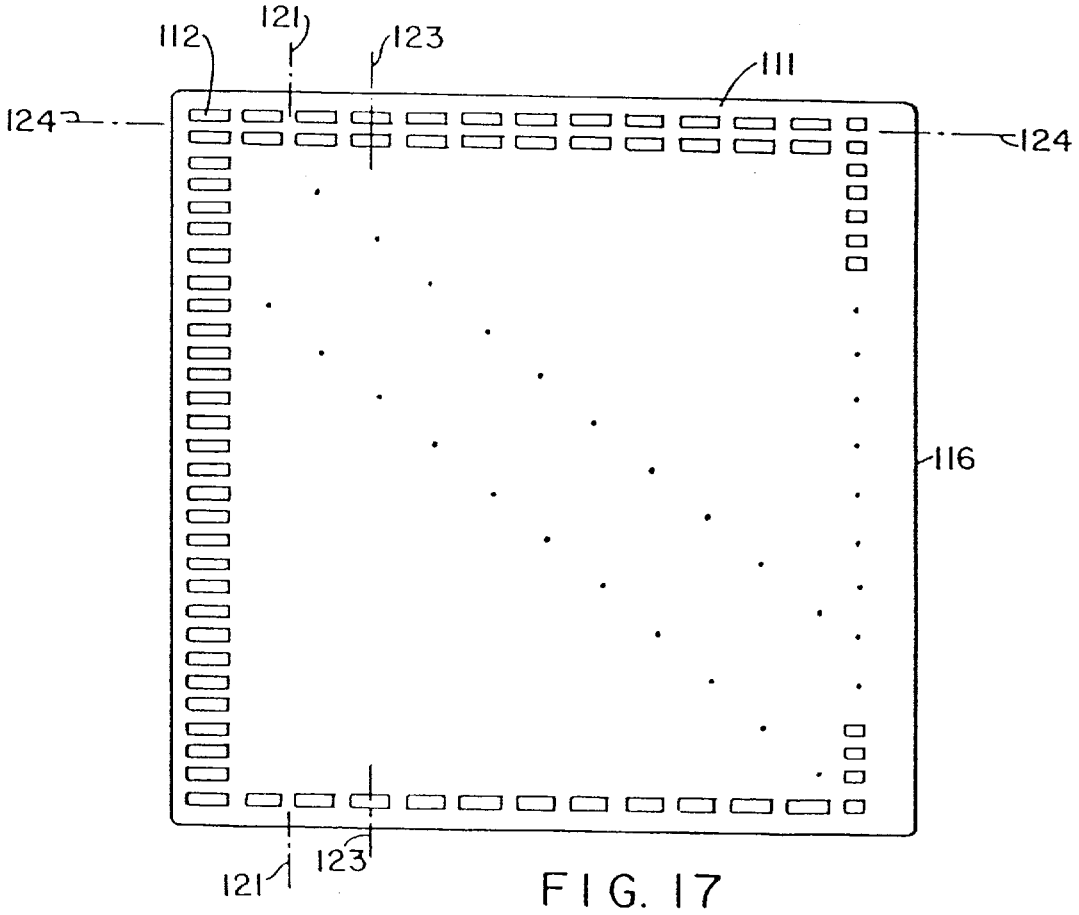
FIG. 17 is a plan view of the final external print, showing the cut planes.
Figure 18:
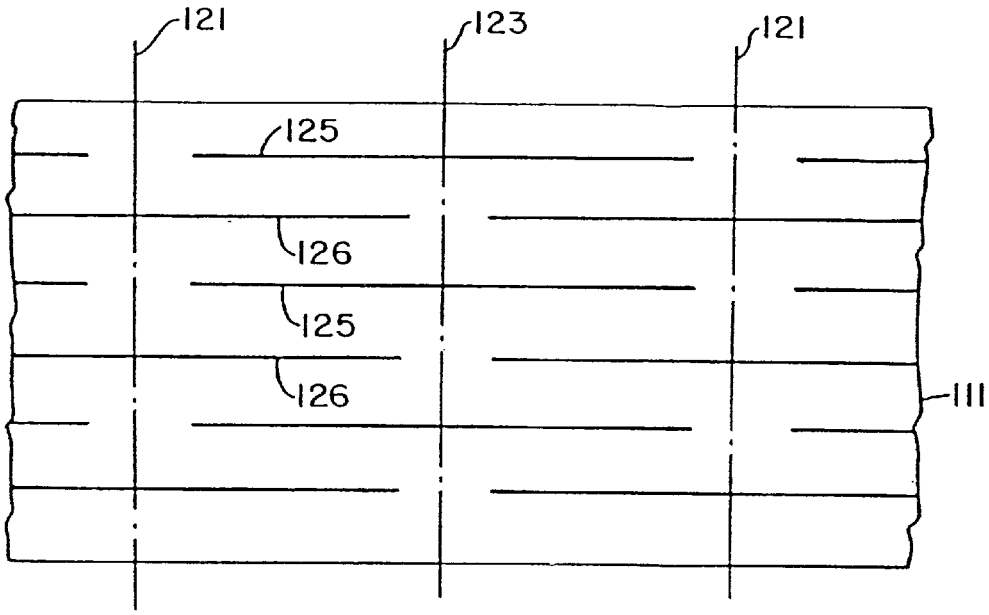
FIG. 18 is a sectional view of the varistor aggregate following printing showing the disposition of the cut planes with respect to the electrode patches.

FIG. 17 is a plan view of the carbon ink print on the top surface of the final ceramic layer, with certain of the cut planes indicated by references 121, 123. It will be seen that a first cut plane 121 extends through the spaces between the carbon patches 112 transverse to their elongate direction, while a second cut plane 123 passes through the carbon patches 112 midway along their axial lengths. Longitudinal cutting planes 124 separate the product between the carbon patches 112 in their longitudinal direction. FIG. 18 is a side view showing the net result of cutting the product in this manner. As the cutting operation takes place through each successive electrode layer, for a first layer 125, the cutting operation leaves two electrode material portions exposed one in each of the end surfaces to each side of the cutting plane 123. Where the cutting plane passes through the level of the next electrode layer 126 down from the layer 125 severed by the cutting operation, it extends through solid ceramic material, so that the electrode layer portions of this next layer terminate inwardly from the cut-off end planes. In this way the varistor structure of the invention as shown in the earlier figures of the present specification is achieved, suitable for the affixing of end terminal caps and the other treatment steps required to produce a finished unit.

Figure 19A:
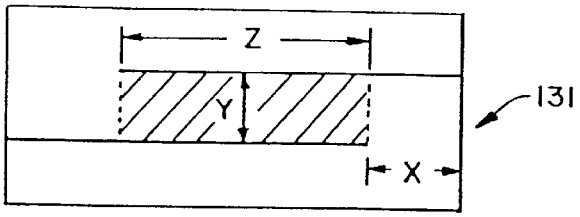
FIGS. 19A and 19B show in section two configurations, respectively, of low voltage varistors of short axial length.

FIG. 19A shows a very low voltage device 131 of short axial length. In order to ensure performance of the device, the end clearance X between each buried electrode layer end and the opposite end term cap surface of the product must be greater than the dimension Y, i.e. the layer separation dimension in the overlap region. Low voltage units can be as short as 1.5 mm in axial length. Dimension X however may vary depending on the position of the cut plane. In a very short product, it can be difficult to ensure that dimension X is always greater than the overlap region electrode layer spacing Y, due to unavoidable variations in cut plane location in the axial or endwise direction.

Figure 19B:
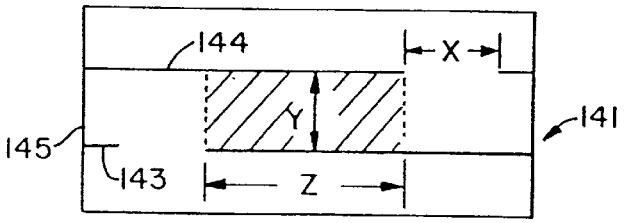
Figure 20:
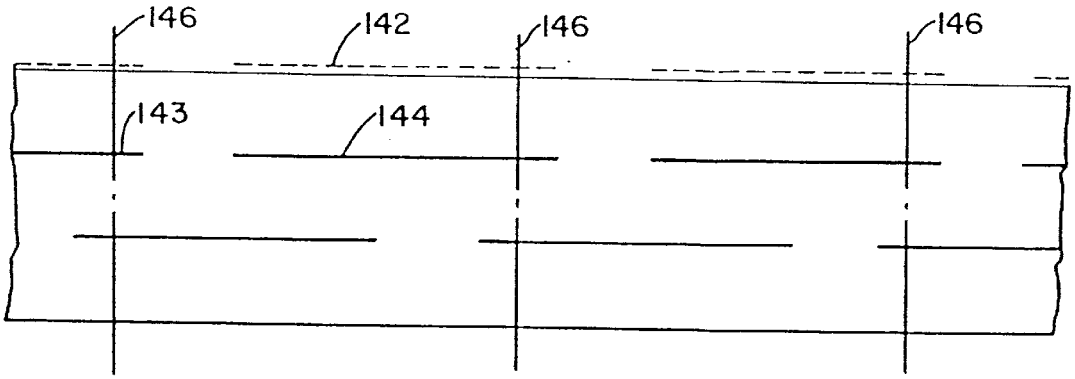
FIG. 20 shows an alternative arrangement of cut planes for a product of short axial length in an embodiment of the invention.

In FIG. 19B and in FIG. 20, an alternative structure 141 of the product is shown in which a different cut strategy is used. Instead of cutting through the varistor product substantially in line with the spaces between electrode ink patches 142 in the electrode layers, the cut planes 146 pass through the electrode material in all of the layers, which are arranged in the relative disposition shown in the sectional view of FIG. 20. Thus, instead of the division between two electrode material portions in one layer being aligned substantially with the center of an electrode region or zone in the next layer, the divisions are displaced so that each division overlies an electrode portion close to the space or separating distance between the electrode zones of the next layer. This skewed arrangement in conjunction with the alternative cut strategy leaves a short portion of electrode material 143 spaced from the main electrode 144, but communicating with the opposite end term cap face 145. In effect, there is a short portion of dead electrode material serving no useful purpose in electrical terms. The constructional advantage is however that dimension X can be very closely controlled during the printing operation so that it will always exceed overlap region layer spacing dimension Y. Within the same overall package length, some 90% of the overlap length Z available in a unit in which the electrode layers end fully clear of the end term caps, as shown in FIG. 19A, may be achieved. This degree of overlap is usually sufficient for most purposes. However, the same overlap dimension Z as in FIG. 19A can be preserved in the arrangement of FIG. 19B by axial extension of the overall length of the product, if appropriate.

A further advantage of this variant is that it minimizes reaction with the end term electrode. The effective operating region of the varistor is displaced to an extent farther away from the end term caps 6, for example, which is advantageous.

Figure 21A:
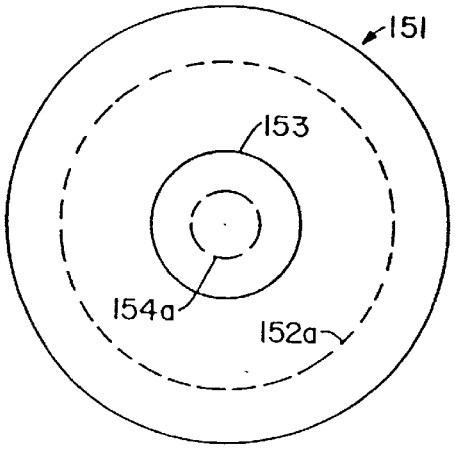
FIGS. 21A and 21B are each plan views showing electrode print patterns for discoidal products of the invention.
Figure 21B:
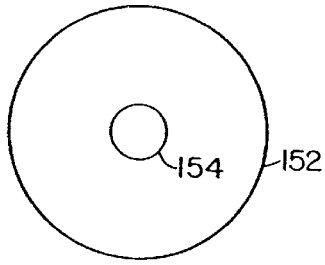

FIGS. 21A and 21B show screen- printing patterns, respectively, for discoidal varistors of the kind shown for example in FIG. 8, 9, 10 and 11. As shown in FIGS. 21A and 21B, two patterns 151, 152, respectively, are used, each of which is an annular ring. The larger annular ring 151, which has a large central aperture 153, forms the outer electrode of the finished disc, extending to the outer peripheral surface of the discoidal unit following the separation step. The second annular ring 152, which is smaller, forms the inner electrode. The small bore central aperture 154 of ring 152 extends to the punched or drilled inner hole passing through the discoidal product in the finished unit. Ghost lines 152*a* and 154*a* show the relative dispositions of the inner and outer peripheries of ring 152, when centered on larger ring 151.

Figure 22:
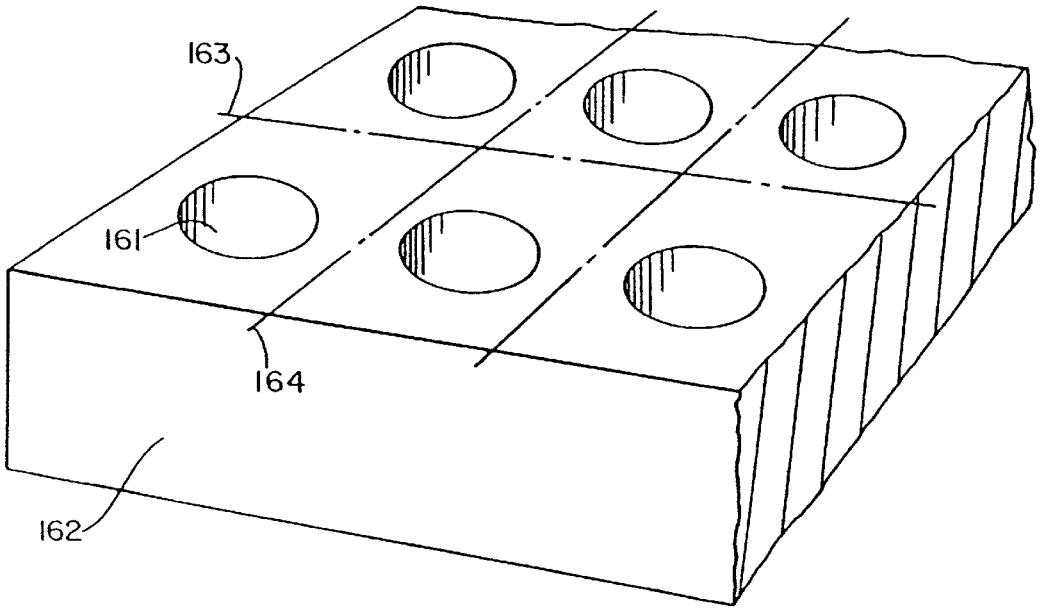
FIG. 22 is a pictorial view of a final external surface print and the separating or cut planes for a discoidal varistor product of an embodiment of the invention.

FIG. 22 is a pictorial view showing the final carbon print for discoidal varistor products 161, on a substrate 162, along with separation or dividing or cut planes 163, 164.

Figure 23A:
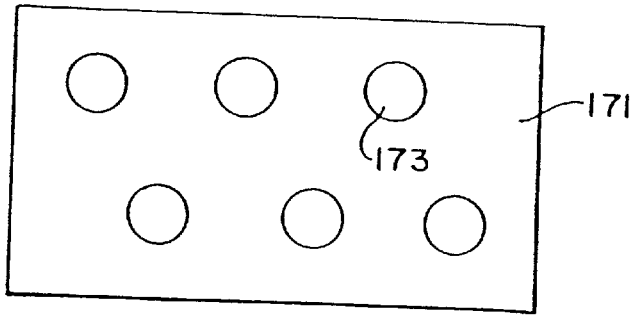
FIGS. 23A and 23B show a print pattern for planar varistor arrays.
Figure 23B:
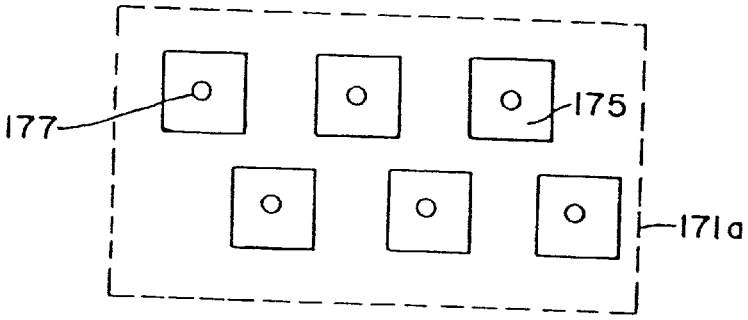
Figure 24A:
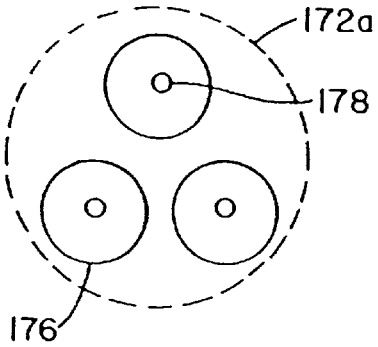
FIGS. 24A and 24B show a printed pattern for circular arrays.
Figure 24B:
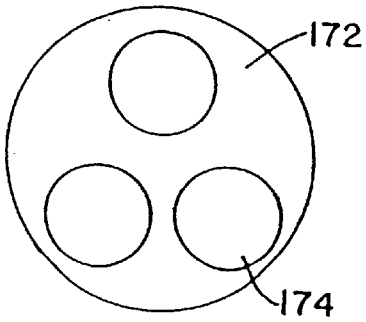

FIGS. 23A, 23B, 24A, and 24B show print patterns for arrays, planar arrays in FIGS. 23A and 23B, and circular arrays in FIG. 24A and 24B. In an array-type varistor structure, a large ground plate 171 (FIG. 23A), 172 (FIG. 24B) is provided with holes or apertured areas 173, 174, respectively, and in FIGS. 23B and 24A, a multiplicity of individual electrodes 175, 176, respectively, are defined for each aperture or hole 173, 174, respectively, by means of a second printing operation within a boundary 171*a*, 172*a*, respectively, corresponding to the periphery of the ground plate 171, 172. The second printing operation provides the pin-out contact areas defined by small diameter apertures 177, 178 within the finished product. Arrays can also have very large numbers of pins and can be of overall circular configuration (FIG. 24B), or so-called D-type or rectangular units (FIG. 23A). In D-type arrays, each row of pins 177 is typically offset by half the pitch of the pins 177 relative to the adjacent row or rows. In addition, the printed electrode ink areas defining the pin-out contact regions may have any of a diversity of configurations, including circular, square, elliptical and irregular.

Following subdivision of the finished laminate by sawing, where required, or without cutting or with only limited cutting, where arrays or larger units are in question, the individual products are removed from the substrate by any suitable means.

The products of the present process may be distinguished from those prepared by so-called dry methods, where a sheet of ceramic material is initially prepared and interleaved in a production process with layers of electrode material. The products of the invention have a denser structure than a product built-up by a dry process, which may have a greater degree of porosity in the finished sintered product.

Figure 25A:
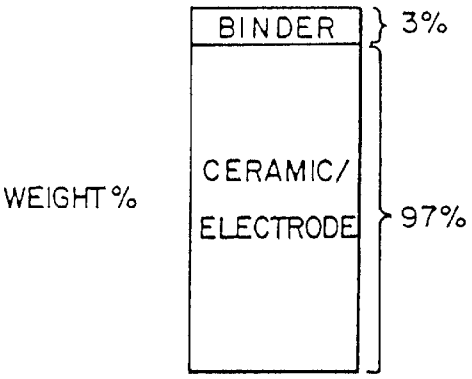
FIGS. 25A, 25B, 25C, and 25D are diagrammatic representations of the constituents of a pre-sintered varistor achieved by screen printing and dry processes, respectively.
Figure 25B:
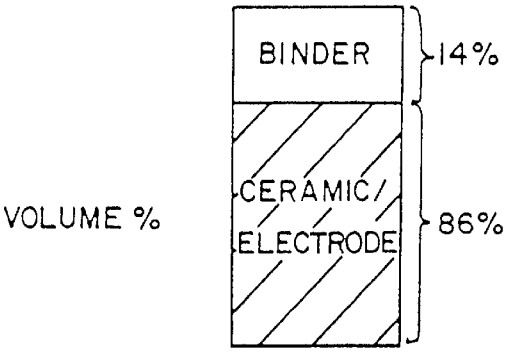
Figure 25C:
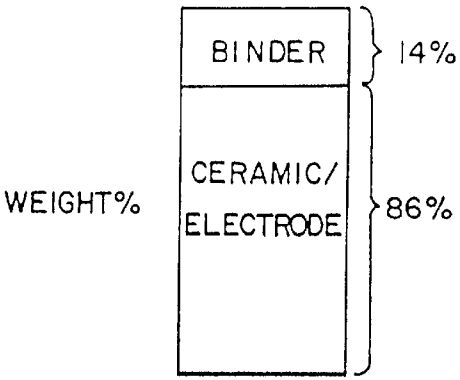
Figure 25D:
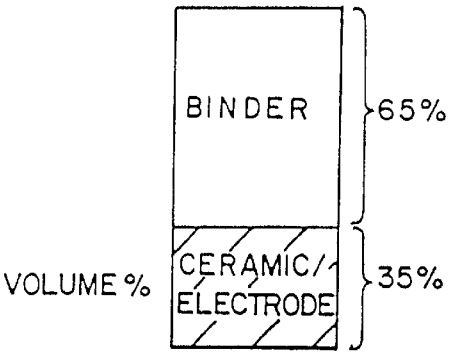

The reason for this difference will be apparent from the diagrams of FIGS. 25A, 25B, 25C, 25D. FIGS. 25A and 25B, show the weight proportions, and volume proportions, respectively, of a varistor product produced by a wet screen printing process, while the corresponding representations of FIGS. 25C and 25D, respectively, show similar analyses for varistors produced by dry processes. Comparing first the weight breakdown of the wet and dry products, it will be seen that for the same weight percentage of powder, which is what remains following the heat treatment or sintering operations, binder and organics are present in different weight proportions as between the two manufacturing processes, typically 3.0% binder for the wet process, and up to 12.0% for the dry process. Thus, following sintering and the volatilization of the organics and binders, the weight of dry ceramic material remaining is identical for the wet process and dry process products. However, referring now to the volume percentages shown in the lower diagrams, in the wet process, the binder represents only 20.0% by volume of the pre-sinter phase product, while in the dry process product, the binder is up to 70.0% by volume. The shaded area of these volume percentage drawings show the dry powder that remains after sintering, and it will be immediately apparent that this is in a much denser form for the wet process product than it is for the dry process product. In other words, the porosity of the dry process product is significantly greater, to a measurable extent, than that of the wet process product. This distinguishing enhanced density is a specific property of varistors prepared by the present method and system, and may be identified in both qualitative and quantitative terms in finished products.

The present printing process especially facilitates the manufacture of multilayer varistors having relatively thin layers of ceramic material of controlled and even thickness. The method is especially suited to the production of multilayer varistors in which the ceramic layers are 30 microns or less. The wet process printing technique enables consistency of layer thickness and parallelism of successive layers to be maintained more closely than by dry processes in varistors falling within this dimensional categorization.

Although various embodiments of the invention have been described herein for purposes of illustration, they are not meant to be limiting. Variations and modifications of these embodiments of the invention may occur to those of ordinary skill in the art, which modifications are meant to be covered by the spirit and scope of the appended claims.

What is claimed is:

1. A process for forming a plurality of varistor precursors, said varistor precursors comprising alternating layers of a varistor ceramic precursor material and electrode precursor material, said varistor ceramic precursor material and said electrode precursor material being capable of forming ceramic layers and electrode layers, respectively, of a zinc oxide varistor when said varistor precursors are subjected to sintering conditions, said process comprising (a) forming a first ceramic layer of said varistor ceramic precursor material, (b) applying a first electrode layer on said first ceramic layer by coating said first ceramic layer with electrode precursor material, said first electrode layer comprising a plurality of discrete, spaced areas composed of said electrode precursor material, said plurality of spaced areas being arranged in a first pattern, (c) forming a second ceramic layer by screen printing said first electrode layer with said varistor ceramic precursor material, (d) applying a second electrode layer on said second ceramic layer by coating said second ceramic layer with electrode precursor material, said second electrode layer comprising a plurality of discrete spaced areas composed of said electrode precursor material, the plurality of spaced areas in said second electrode layer being arranged in a second pattern different from said first pattern, (e) forming a third ceramic layer on said second electrode layer by screen printing to form a composite, and (f) dividing the composite of step (e) into said plurality of varistor precursors.

2. The process of claim 1 wherein steps (b) and (d) are repeated at least once to produce a composite having a first ceramic layer on one side thereof, a third ceramic layer on the opposite side thereof and a plurality of first and second electrode layers between said first and third ceramic layers, said plurality of first and second electrode layers being arranged in alternating relationship, said process further comprising repeating step (c) at least twice so that a second ceramic layer is arranged between each pair of adjacent first and second electrode layers.

3. The process of claim 1 wherein said first pattern and said second pattern each define a common longitudinal direction and a common transverse direction, said composite being composed of a plurality of varistor precursors arranged in multiple columns extending in said longitudinal direction and multiple rows extending in said transverse direction.

4. The process of claim 3 wherein said first and said third ceramic layers are made by screen printing.

5. The process of claim 3 wherein the spaced areas in said first electrode layer overlap the spaced areas in said second electrode layer in the longitudinal direction.

6. The process of claim 5 wherein each second ceramic layer is formed by screen printing a screen printing ink made from a thixotropic dispersion of ceramic-forming ingredients in an organic liquid.

7. The process of claim 6 wherein said ceramic-forming ingredients have a particle size of 2.0 microns or less.

8. The process of claim 7 wherein said ceramic-forming ingredients have a particle size of about 1.6 microns ±10%.

9. The process of claim 8 wherein said thixotropic dispersion contains an organic binder such that the amount of organic binder in said varistor ceramic precursor material after evaporation of the organic liquid therein is about 20% by volume.

10. The process of claim 6 wherein said thixotropic dispersion contains an organic binder such that the amount of organic binder in said varistor ceramic precursor material after evaporation of the organic liquid therein is about 20% by volume.

11. The process of claim 3 wherein said composite is subdivided along a plurality of longitudinal cut planes for separating columns of varistors from one another, said composite also being subdivided along a plurality of transverse cut planes for separating rows of varistors from one another, whereby said composite is subdivided into said plurality of varistor precursors.

12. The process of claim 11 wherein the spaced areas in said first electrode layer overlap the spaced areas in said second electrode layer in said longitudinal direction.

13. The process of claim 12 wherein said composite is subdivided in such a way that adjacent varistor precursors arranged in columns are separated from one another during said subdivision along only a single transverse cut plane.

14. The process of claim 13 wherein said composite is subdivided in such a way that adjacent varistor precursors arranged in rows are separate from one another during said subdivision along only a single longitudinal cut plane.

15. The process of claim 14 wherein the discrete spaced areas of electrode precursor material in successive first electrode layers register with one another and further wherein said transverse cut planes are arranged in alternating pairs, a first transverse cut plane of each of said pairs passing through the discrete spaced areas of said first electrode layers but not the discrete spaced areas of said second electrode layers.

16. The process of claim 15 wherein the discrete spaced areas of electrode precursor material in successive second electrode layers register with one another, and further wherein the second transverse cut plane of each of said pairs passes through the discrete spaced areas of said second electrode layers but not the discrete spaced areas of said first electrode layers.

17. The process of claim 13 wherein the discrete spaced areas of electrode precursor material in successive first electrode layers register with one another and further wherein said transverse cut planes are arranged in alternating pairs, a first transverse cut plane of each of said pairs passing through the discrete spaced areas of said first electrode layers but not the discrete spaced areas of said second electrode layers.

18. The process of claim 17 wherein the discrete spaced areas of electrode precursor material in successive second electrode layers register with one another, and further wherein the second transverse cut plane of each of said pairs passes through the discrete spaced areas of said second electrode layers but not the discrete spaced areas of said first electrode layers.

19. The process of claim 12 wherein the discrete spaced areas of electrode precursor material in successive first electrode layers register with one another and further wherein said transverse cut planes are arranged in alternating pairs, a first transverse cut plane of each of said pairs passing through the discrete spaced areas of said first electrode layers but not the discrete spaced areas of said second electrode layers.

20. The process of claim 19 wherein the discrete spaced areas of electrode precursor material in successive second electrode layers register with one another, and further wherein the second transverse cut plane of each of said pairs passes through the discrete spaced areas of said second electrode layers but not the discrete spaced areas of said first electrode layers.

21. The process of claim 1 wherein said first and third ceramic layers are formed from the same ceramic as said second ceramic layer.

22. The process of claim 1 wherein said first and third ceramic layers are formed from a different ceramic from the ceramic forming said second ceramic layer.

23. The process of claim 1, wherein upon completion of step (e), said process consists essentially of (f) dividing the composite of step (e) into said plurality of varistor precursors.

24. The process of claim 23, wherein upon completion of step (e), said process consists of (f) dividing the composite of step (e) into said plurality of varistor precursors.

25. The process of claim 1, wherein the layer of said composite formed last is formed by a last printing step, and further wherein upon completion of said last printing step said composite is divided into said plurality of varistor precursors.

26. The process of claim 11, wherein immediately after the last layer of said composite is formed, said composite is divided into said plurality of varistor precursors.

27. A method for producing a multiplicity of varistors comprising the steps of:

(a) printing a first layer of a ceramic material onto a substrate, (b) printing a multiplicity of spaced areas of conductive material onto said ceramic layer, (c) printing a further ceramic layer to cover said multiplicity of spaced areas, (d) repeating steps (b) and (c) at least once until a final layer of ceramic material is printed thereby producing a product, (e) dividing the product of step (d) to provide a multiplicity of portions, each portion having a plurality of layers of ceramic material and a plurality of layers of electrode material, said layers being interleaved with each layer of electrode material being sandwiched between two ceramic layers, and (f) sintering said portions to form said multiplicity of varistors.

28. The process of claim 27, wherein during step (d) a final layer of electrode material and a final layer of ceramic material are formed thereby producing said product, said process further characterized in that after said final layer of electrode material is formed and prior to sintering said process consists essentially of forming said final layer of ceramic material and thereafter dividing said product to produce said multiplicity of portions.

29. The process of claim 28, wherein after said final layer of electrode material is formed and prior to said sintering said process consists of forming said final layer of ceramic material and thereafter dividing said product to produce said multiplicity of portions.

30. The process of claim 27, wherein upon completion of the formation of said final layer of ceramic material and prior to said sintering, said process consists essentially of dividing said product to produce said multiplicity of portions.

31. The process of claim 30, wherein upon completion of the formation of said final layer of ceramic material and prior to said sintering, said process consists of dividing said product to produce said multiplicity of portions.

32. The process of claim 27, wherein the layer of said product formed last is formed by a last printing step, and further wherein upon completion of said last printing step said product is divided into said multiplicity of portions.

33. The process of claim 27, wherein immediately after the last layer of said product is formed, said product is divided into said multiplicity of portions.

* * * * *

UNITED STATES PATENT AND TRADEMARK OFFICE

CERTIFICATE OF CORRECTION

PATENT NO. : 6,183,685 B1
DATED : February 6, 2001
INVENTOR(S) : Stephen P. Cowman, et al.

It is certified that error appears in the above-identified patent and that said Letters Patent is hereby corrected as shown below:

Title page,
Item [73] Assignee: shoul read as following -- Littelfuse Inc. --

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 6,183,685 B1
DATED : February 6, 2001
INVENTOR(S) : Stephen P. Cowman et al.

It is certified that error appears in the above-identified patent and that said Letters Patent is hereby corrected as shown below:

Title page,
Item [73], Assignee, should read as following -- Littelfuse Inc. --

Signed and Sealed this

Eighth Day of January, 2002

*Attest:*

*Attesting Officer*

JAMES E. ROGAN
*Director of the United States Patent and Trademark Office*